US005894710A

United States Patent [19]

Balder

[11] Patent Number: 5,894,710

[45] Date of Patent: Apr. 20, 1999

[54] PACKAGE SQUARING DEVICE

[75] Inventor: Richard E. Balder, Brainerd, Minn.

[73] Assignee: Riverwood International Corporation, Atlanta, Ga.

[21] Appl. No.: 08/984,891

[22] Filed: Dec. 4, 1997

[51] Int. Cl.[6] ..... B65B 21/02

[52] U.S. Cl. ..... 53/398; 53/48.9

[58] Field of Search ..... 53/398, 48.9, 48.7, 53/387.2, 377.5, 377.6, 378.3

[56] References Cited

U.S. PATENT DOCUMENTS

| | | | |
|---|---|---|---|
| 3,543,473 | 12/1970 | Cato | 53/48.9 |
| 3,548,566 | 12/1970 | Sherman | 53/48.9 |
| 3,815,320 | 6/1974 | Ganz | 53/48.9 |
| 4,338,760 | 7/1982 | Kuhn | 53/48.9 |
| 4,481,750 | 11/1984 | Cooley | 53/48.9 X |
| 4,566,248 | 1/1986 | Cooley | 53/48.9 |
| 4,651,502 | 3/1987 | Ganz | 53/48.9 |
| 5,036,644 | 8/1991 | Lashyro et al. . | |
| 5,241,806 | 9/1993 | Ziegler et al. . | |
| 5,456,058 | 10/1995 | Ziegler . | |
| 5,457,940 | 10/1995 | Ziegler et al. . | |

*Primary Examiner*—John Sipos

*Attorney, Agent, or Firm*—Skinner and Associates; Steve McLary

[57] ABSTRACT

A package squaring device for folding flaps on cartons traveling on a continuous carton conveyor, including a lug attached to an endless flight chain, a flap tucker pivotally connected to the lug, and a cam bar slidably linked to the flap tucker. The lug further includes a member constructed and arranged to engage and stabilize a carton. An endless flight of package squaring devices are synchronized with the continuous carton conveyor so that one or more package squaring devices are traveling operationally adjacent to a carton. The cam bar is forced up and lifts the flap tucker as the package squaring device travels over a cam. The flap tucker is designed to fold a flap on a carton when it is lifted. The cam bar is forced down and lowers the flap tucker when the package squaring device travels off of the cam. The flap tucker of the present invention forms a moveable plow for laterally folding a carton flap while minimizing the longitudinal component forces that tend to skew cartons.

16 Claims, 7 Drawing Sheets

34
54
96
78
98
10
110a
110b
112a
112b
90
86b
86a
94
62a
62b
56b
56a
84
134
32

96
78
44a
80b
62a
98
114a
94
44b
110b
38
62b
30
114b
134
32
108a
66a
102a
70a
34
36
112a
66b
100a
70b
102b
108b
112b
106
100b

PACKAGE SQUARING DEVICE

BACKGROUND OF THE INVENTION

1. Field of the Invention

The present invention relates, generally, to apparatus and methods used in the packaging industry. More particularly, the invention relates to apparatus and methods for folding flaps of cartons traveling in a continuous stream. The invention has particular utility in folding the major flap of a six-sided carton while maintaining the relatively squared corners of the carton.

2. Background Information

The state of the art includes various devices and methods for folding flaps of cartons traveling on a continuous carton conveyor. These devices include stationary plows and rotary tuckers. U.S. Pat. No. 5,036,644, assigned to applicant's assignee, illustrates a stationary plow; and U.S. Pat. Nos. 5,456,058, 5,457,940, and 5,241,806, all assigned to applicant's assignee, illustrate rotary tuckers.

These devices and methods are believed to have significant limitations and shortcomings. These limitations and shortcomings are especially evident when the known art attempts to fold the major flaps found in the bottom of six-sided cartons. Although stationary plows work well for folding small flaps, they tend to skew six-sided cartons when they attempt to fold the major flap. These cartons are stored and loaded into a carton magazine in a relatively flat shape. The six-sided cartons have a tendency to skew away from a rectangular footprint and back toward their original flat shape after they have been erected on a carton conveyor. The size of the major flaps is another factor that significantly affects the skewing problem. When a carton moves longitudinally over a stationary plow designed to laterally fold the major flap, the plow produces a resultant force. The lateral component of the resultant force folds the flap. However, the longitudinal component of the resultant force pushes the flap of the carton back against the longitudinal flow of the cartons and skews the cartons. Larger flaps cause the stationary plows to induce larger longitudinal component forces, which cause a greater tendency to skew the cartons when the flap is folded.

Rotary flap tuckers are typically used to fold dust flaps or end flaps found on the side of the carton. These flaps are longitudinally folded either with or against the flow of the stream of cartons. However, the major flap of the six-sided cartons are folded in a direction lateral to the flow of the stream of cartons. Therefore, these rotary flap tuckers would have to be adapted to laterally fold these bottom flaps. However, these stationary rotary flap tuckers would either have to operate at a speed that exerts considerable force on the cartons and thus skews the cartons, or they would require the cartons to travel at a lower speed or with intermittent motion.

Applicant's invention provides a package squaring device, or flap lifter, which overcomes the limitations and shortcomings of the known art. Specifically, it acts as a moveable plow that longitudinally travels along side of the cartons and produces a gentle lateral force to fold the flaps. Therefore, the package squaring device does not create the resultant forces that tend to skew the cartons.

BRIEF SUMMARY OF THE INVENTION

The present invention provides a flap lifter or package squaring device for folding flaps on cartons. The package squaring device generally comprises a lug, a flap tucker pivotally connected to the lug, and a cam bar slidably linked to the flap tucker. A plurality of squaring devices are attached to a flight chain or other endless conveyance mechanism, and thus form an endless flight or series of package squaring devices. Each lug contacts and stabilizes a carton traveling on a compression conveyor. When the lug travels past a first position, the cam bar is forced upward by a cam and causes the flap tucker to pivot into a generally parallel position to fold the flap of the carton. The cam bar travels off of the cam when the lug travels past a second position, allowing both the cam bar and the flap tucker to lower.

Significant features of the invention include the synchronized motion of a package squaring device with a carton traveling longitudinally on the continuous compression conveyor. This synchronized motion allows each package squaring device to exert a gentle lateral folding force to the flap of a carton and minimizes longitudinal component forces that tend to skew the carton. A preferred embodiment of the package squaring device includes an extension member or finger that controls and stabilizes each carton so that the corners of the carton are relatively squared as the carton undergoes longitudinal motion and when the flaps of the carton are laterally folded.

The features, benefits and objects of this invention will become clear to those skilled in the art by reference to the following description, claims and drawings.

DETAILED DESCRIPTION

Figure 15:
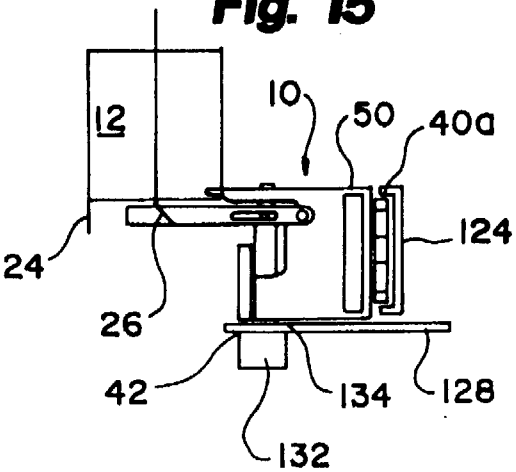
FIG. 15 is a cross-sectional view taken along line 15—15 of FIG. 13.
Figure 16:
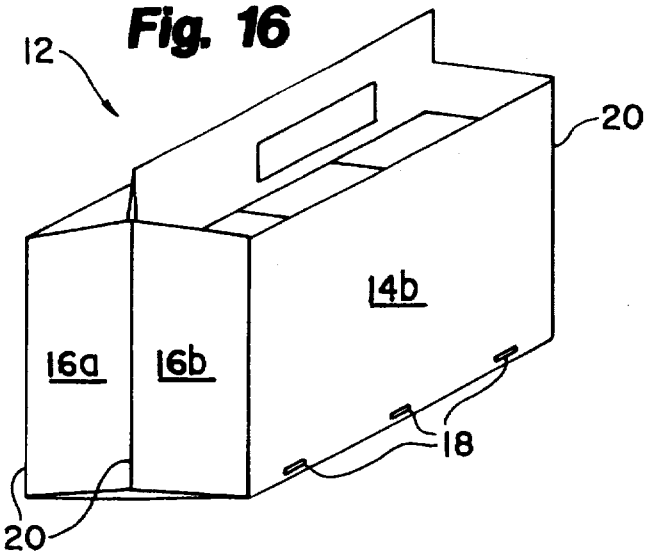
FIG. 16 is a perspective view of a six-sided carton.
Figure 17:
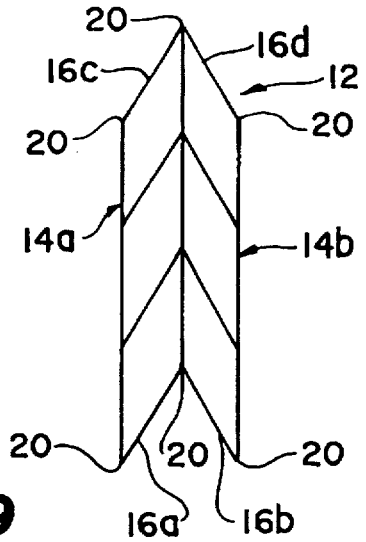
FIG. 17 is a top view of a partially-erected six-sided carton.
Figure 18:
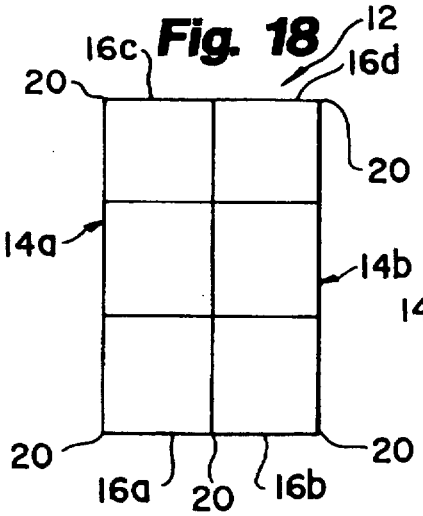
FIG. 18 is a top view of a fully-erected six-sided carton.
Figure 19:
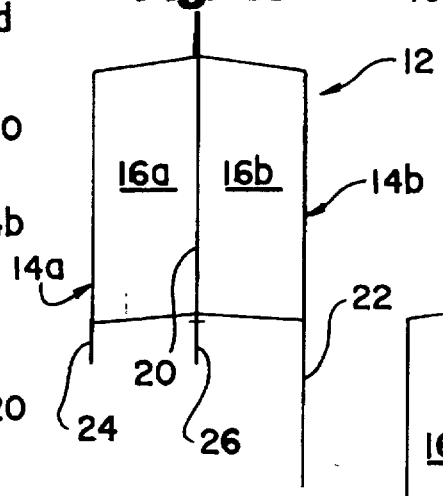
FIG. 19 is a side view of a six-sided carton whose major flap, minor flap, and tabs have not been folded.
Figure 20:
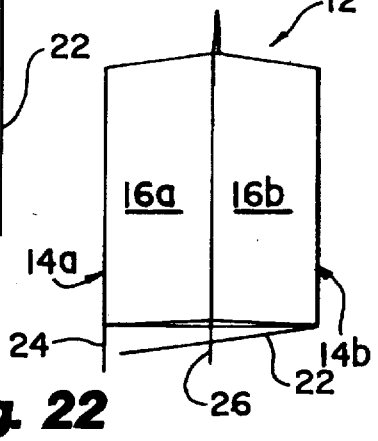
FIG. 20 is a side view of a six-sided carton whose major flap has been folded.
Figure 21:
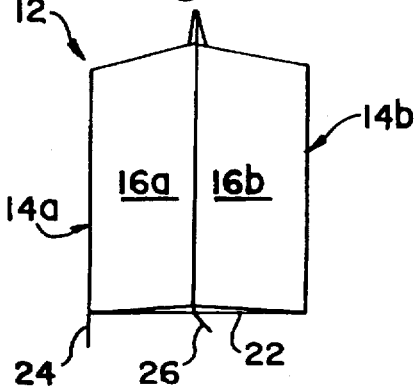
FIG. 21 is a side view of a six-sided carton whose tabs have been folded.
Figure 22:
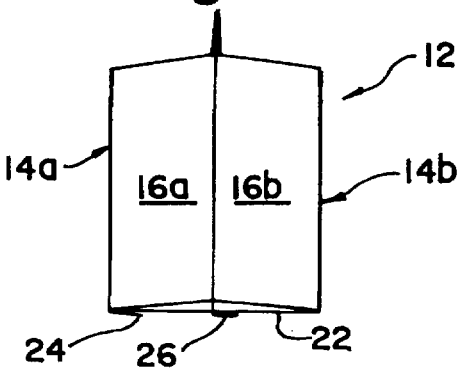
FIG. 22 is a side view of a six-sided carton whose minor flap has been folded.

Referring to FIGS. 1–15, an example of the preferred embodiment of the present invention is illustrated and generally indicated by the reference numeral 10. FIGS. 16–18 illustrate the form and characteristics of a six-sided carton 12 of the type processed by the present invention. A fully-formed, six-sided carton 12 is illustrated in FIG. 16 and includes two side panels 14*a* and 14*b* and four end panels 16*a*, 16*b*, 16*c* and 16*d*. The side panels 14*a* and 14*b* are shown with slots 18. Each panel is separated by a joint or fold 20. These six-sided cartons 12 are stored and loaded into carton cartridges in a relatively flat shape. As shown in FIG. 17, the folds 20 in these paper board cartons 12 have a shape memory that causes the cartons 12 to tend to skew back toward its flat shape. The bottom of the cartons 12 include a major flap 22, a minor flap 24, and one or more tab flaps 26. A method or order for folding these flaps is generally shown in FIGS. 19–22. FIG. 20 shows the major flap 22 being folded over first, FIG. 21 shows one of the tab flaps 26 being folded over next to provide additional support, and FIG. 22 shows the minor flap 24 being folded over last. These flaps are typically glued together to maintain the structural shape of the carton. It is anticipated that the package squaring device 10 of the present invention could be used with other carton types, including cartons having different shapes, different sized flaps, and different orders of assembly. Although the package squaring device 10 is especially useful in folding the relatively large major flap 22 of a six-sided carton 12, it could be used to fold the tab flaps 26 and the minor flap 24 as well. However, these smaller tab flaps 26 and the minor flap 24 are adequately folded using a stationary plow without undue skewing of the carton 12.

The package squaring device 10 is described below first in terms of its major structural elements and then in terms of its secondary structural and/or functional elements which cooperate to form a "moveable plow" that folds the flaps of cartons 12 traveling within a continuous stream. As shown most clearly in FIG. 6, the package squaring device 10 has four major structural elements: a lug 30, a cam bar 32, a flap tucker 34, and a tab 36. The flap tucker 34 is pivotally connected to the lug 30 and hinges between a down position and a relatively horizontal up position. The flap tucker 34 is the element in physical contact with the major flap 22 on the carton 12 and produces the lateral folding motion of the package squaring device 10. The cam bar 32 has limited vertical motion in the cam bar cavity 38 between the lug 30 and the tab 36. The cam bar 32 is linked to the flap tucker 34 in such a manner that an upward motion in the cam bar 32 will lift the flap tucker 34 to fold a flap and a downward motion in the cam bar 32 will lower the flap tucker 34. The lug 30 is attached to an endless flight mechanism or flight chain 40*a* and 40*b*, as shown in FIGS. 12–15, which gives the package squaring device 10 a predetermined travel path. The package squaring device 10 travels over a cam 42 which lifts both the cam bar 32 and the flap tucker 34. The cam bar 32 has a downward bias which lowers the flap tucker 34 as the package squaring device 10 travels off of the cam 42.

Figure 1:
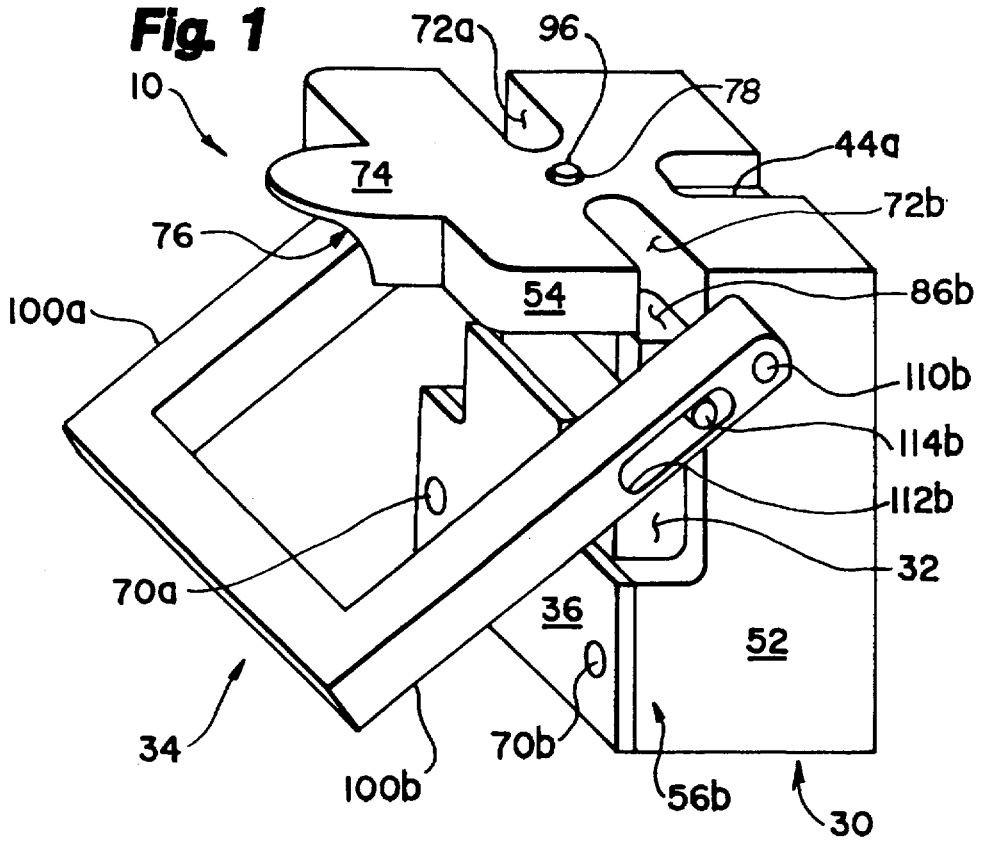
FIG. 1 is a perspective view of the package squaring device of the present invention.
Figure 2:
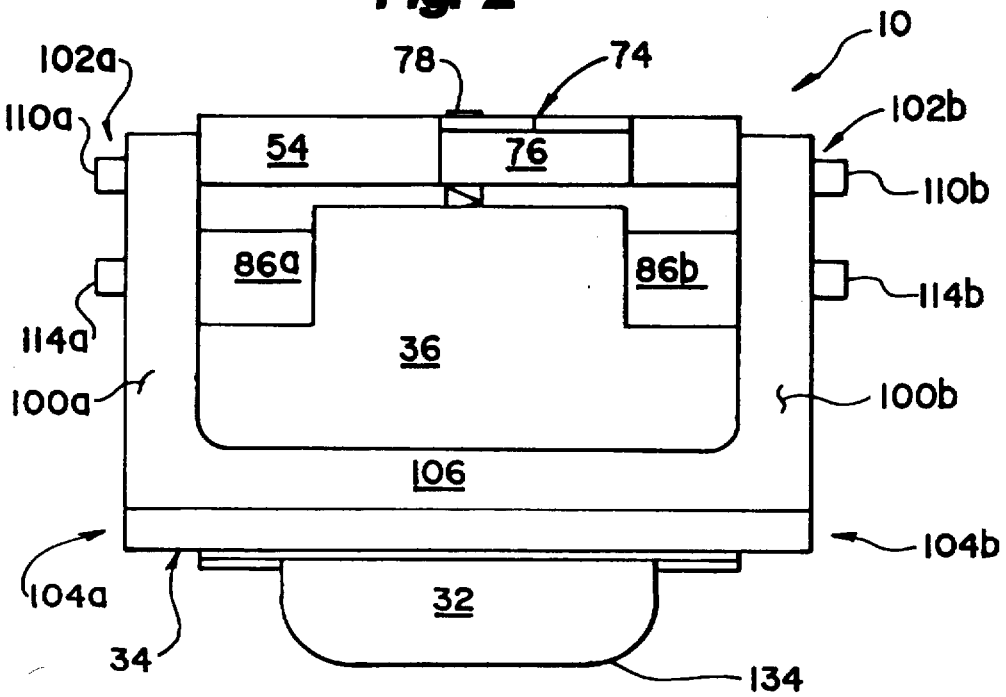
FIG. 2 is a front view of the package squaring device.
Figure 3:
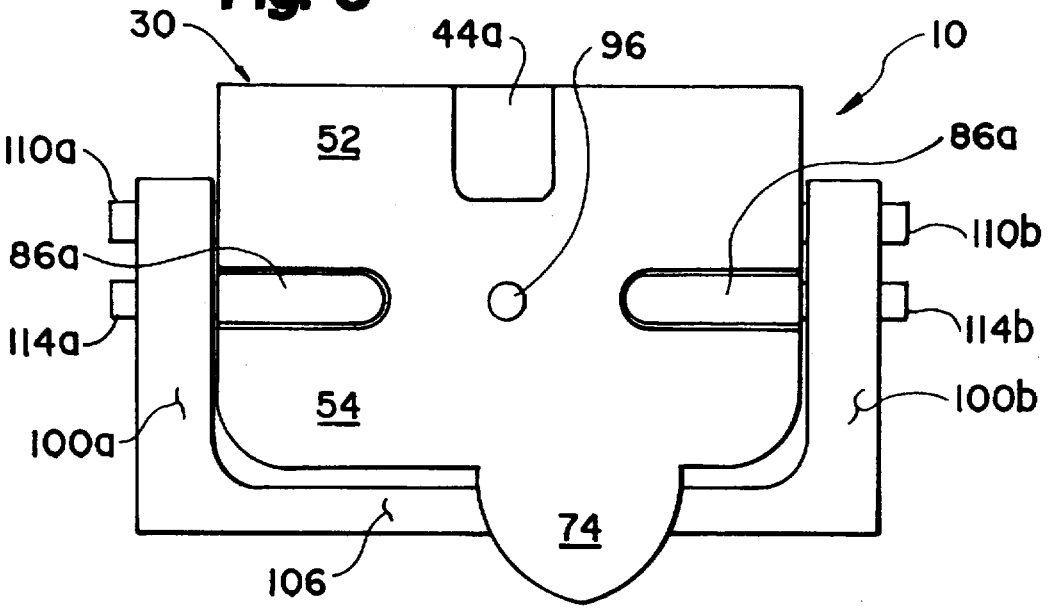
FIG. 3 is a top view of the package squaring device.
Figure 4:
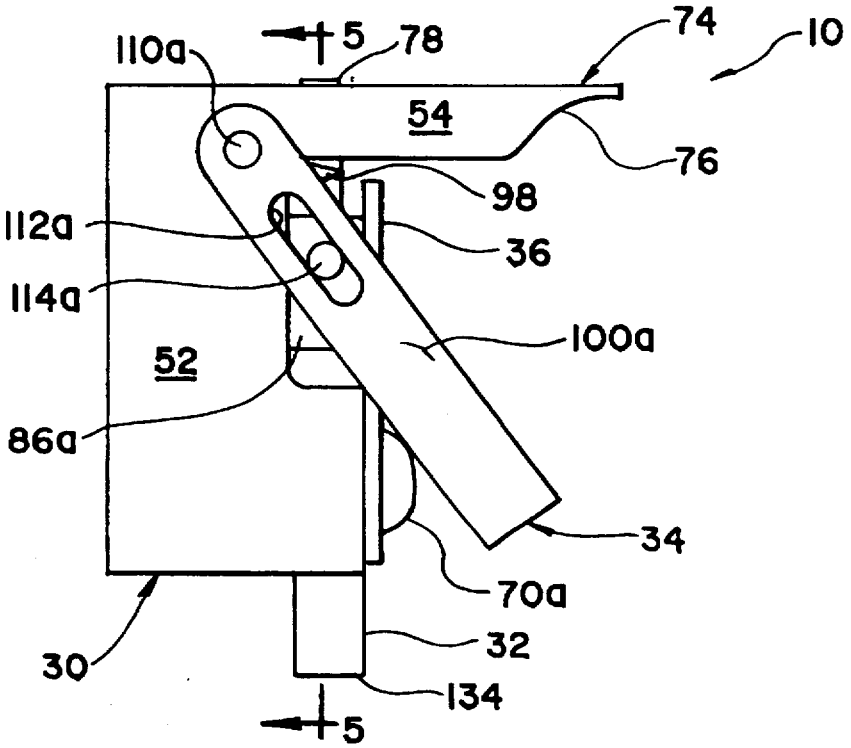
FIG. 4 is a side view of the package squaring device.
Figure 6:
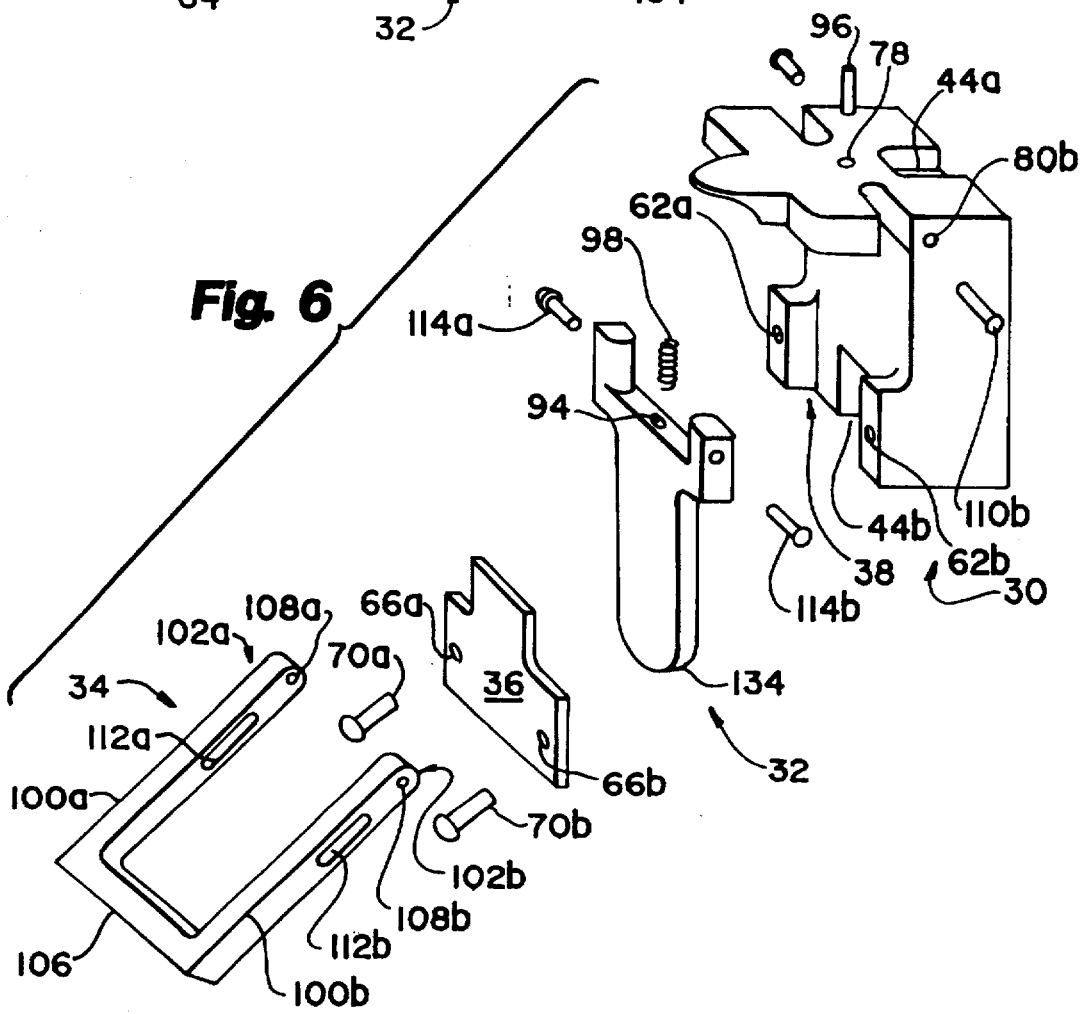
FIG. 6 is an exploded perspective view of the package squaring device.
Figure 7:
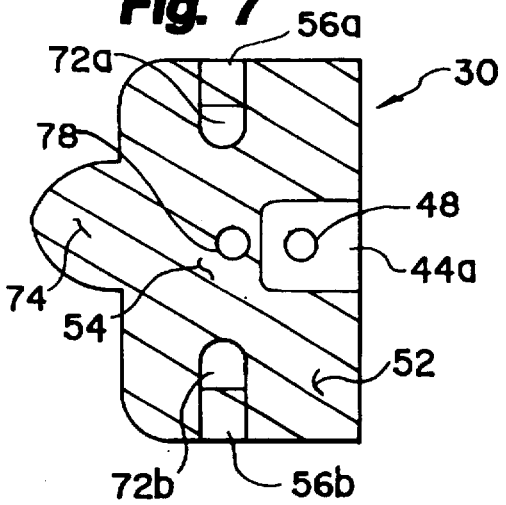
FIG. 7 is a top view of the lug of the package squaring device.
Figure 8:
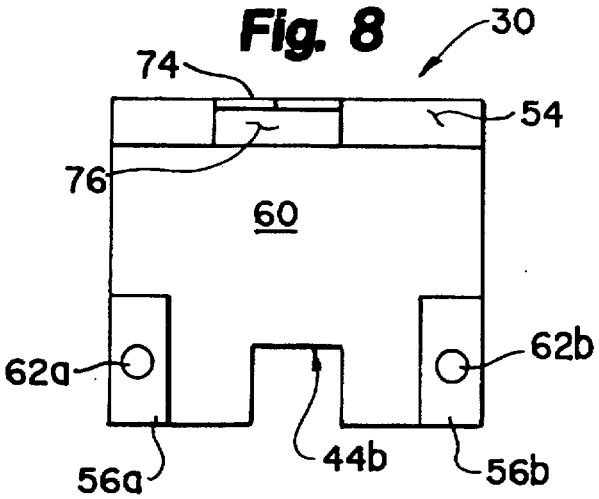
FIG. 8 is a front view of the lug of the package squaring device.
Figure 9:
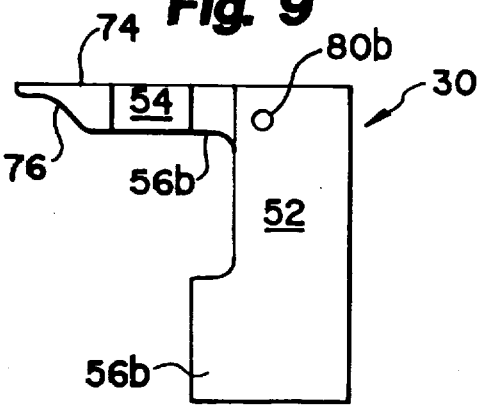
FIG. 9 is a side view of the lug of the package squaring device.
Figure 10:
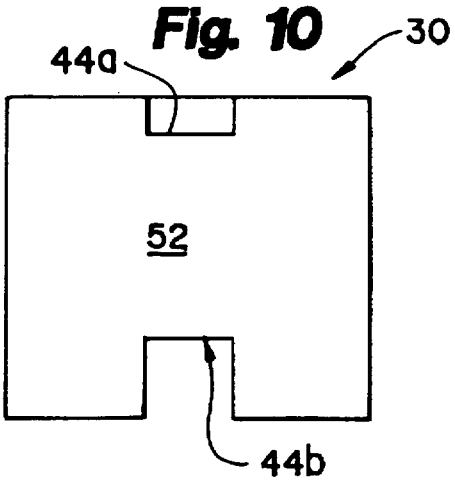
FIG. 10 is a rear view of the lug of the package squaring device.
Figure 11:
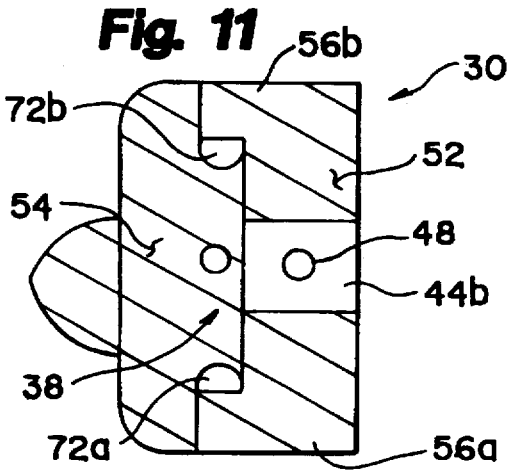
FIG. 11 is a bottom view of the lug of the package squaring device.
Figure 14:
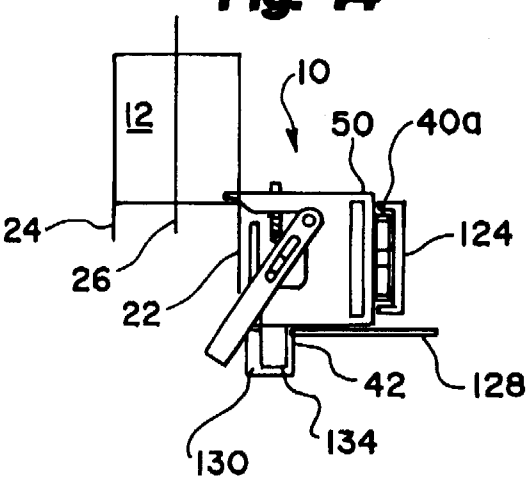
FIG. 14 is a cross-sectional view taken along line 14—14 of FIG. 13.

As shown in the planar views of FIGS. 7–11 and the perspective views of FIGS. 1 and 6, the lug 30 of the preferred embodiment is a unitary element. The lug 30 is connected to the flight chain 40 through an upper 44*a* and lower 44*b* bracket recess, both of which contain a screw aperture 48. FIGS. 14 and 15 illustrate a method for attaching the lug 30 to the flight chain 40 using a bracket 50. The lug 30 further includes a main body 52, a shelf 54, a first leg 56*a* and a second leg 56*b*. The lug 30 has a relatively vertical front face 60 located below the shelf 54 and between the legs 56*a* and 56*b*. The legs 56*a* and 56*b*, shelf 54 and cam bar 32 are constructed and arranged to allow limited vertical motion of the cam bar 32 next to the front face 60. A first tab pin cavity 62*a* and a second tab pin cavity 62*b* are respectively located in the first leg 56*a* and the second leg 56*b*. The tab 36 has corresponding first 66*a* and second 66*b* tab pin apertures for attaching the tab 36 to the legs 56*a* and 56*b* of the lug 30 to form the cam bar cavity 38 using tab pin 70*a* and 70*b*. The shelf 54 extends forward toward the carton 12 and has cam bar apertures 72*a* and 72*b* configured and arranged to freely receive the cam bar 32 when it is in its upward position. The shelf 54 also has a forwardly extending finger 74 designed to engage the carton 12 using the slots 18. As shown best in FIG. 4, the finger 74 has an arcuate bottom surface 76 designed to create a stabilizing, downward force on the carton 12 when the finger 74 is fully inserted into a carton slot 18. As will be explained further below, the shelf 54 also has a bias pin aperture 78, and the lug 30 has two pivot pin cavities 80*a* and 80*b*.

Figure 5:
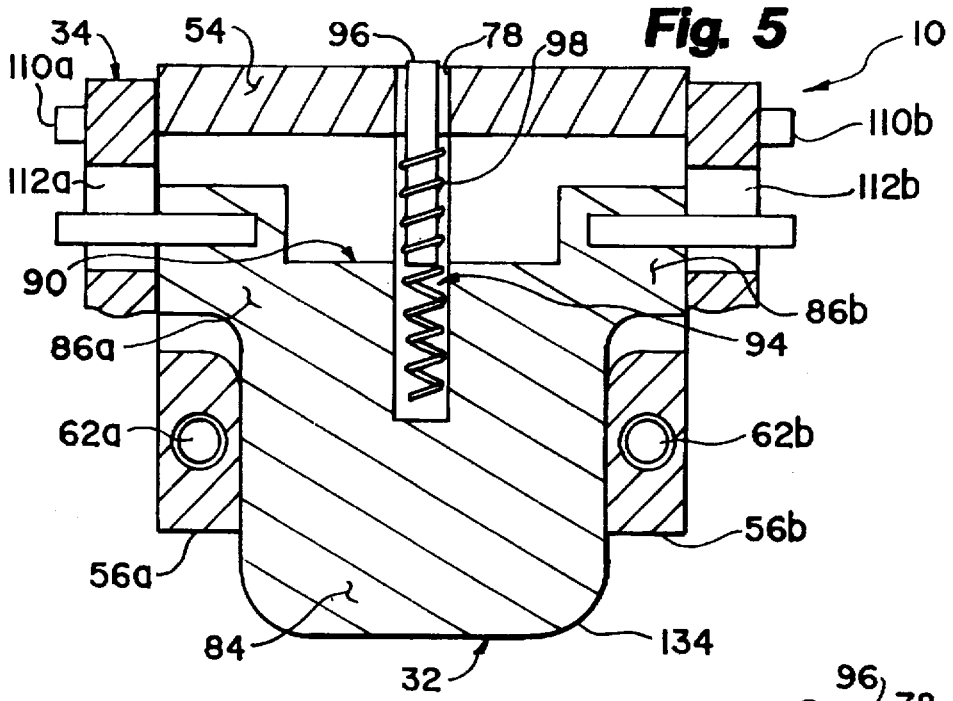
FIG. 5 is a cross-sectional view of the package squaring device taken along line 5—5 of FIG. 4.

As shown most clearly in FIGS. 5 and 6, the cam bar 32 of the preferred embodiment is a unitary element with a body portion 84 and two shoulders 86*a* and 86*b*. The cam bar 32 has the form of a uniformly thick plate and has rounded bottom for engaging a cam 42. As will be explained in more detail below, each shoulder 86*a* and 86*b* has a respective cam pin cavity 88*a* and 88*b* for interfacing with the flap tucker 34. The top 90 of the cam bar 32 contains a bias pin cavity 94 sized to receive a bias pin 96 and a bias spring 98. The bias pin 96 is also received within the bias pin aperture 78 in the shelf 54. The bias spring 98 surrounds the bias pin 96, fits below the shelf 54, and provides a downward bias to the cam bar 32.

As shown in FIGS. 1 and 6, the flap tucker 34 of the preferred embodiment is a unitary structure having a general shape of a handle. The flap tucker 34 has two substantially parallel arms 100*a* and 100*b*. Each arm has a pivot end 102*a* and 102*b* and a load end 104*a* and 104*b*. A cross member 106 is attached to each load end 104*a* and 104*b*. Each arm has a pivot pin aperture 108*a* and 108*b* located at the pivot end 102*a* and 102*b*. Pivot pins 110*a* and 110*b* are inserted through the pivot pin apertures 108*a* and 108*b* into the pivot pin cavities 80*a* and 80*b* in the lug 30. Each arm also has a cam pin slot 112*a* and 112*b*. Cam pins 114*a* and 114*b* are inserted into the cam pin cavities 82*a* and 82*b* of the lug. These cam pins 114*a* and 114*b* are slidably linked to the cam pin slots 112*a* and 112*b* in such a manner as to allow the cam bar 32 to lift the flap tucker 34 when raised and to allow the cam bar 32 to lower the flap tucker 34 when lowered.

Figure 12:
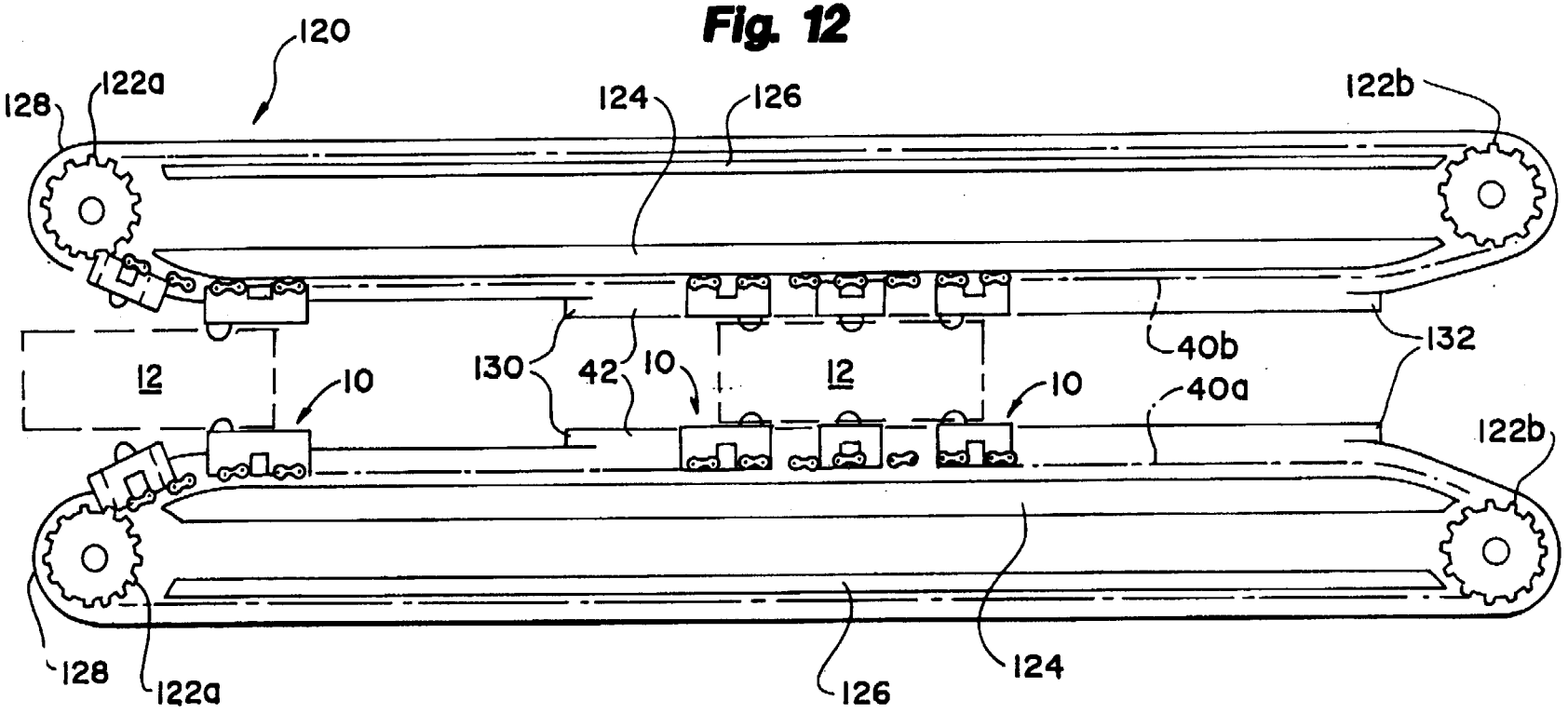
FIG. 12 is a top view of a compression conveyor showing two endless flights of a plurality of package squaring devices engaging a continuous stream of cartons.
Figure 13:
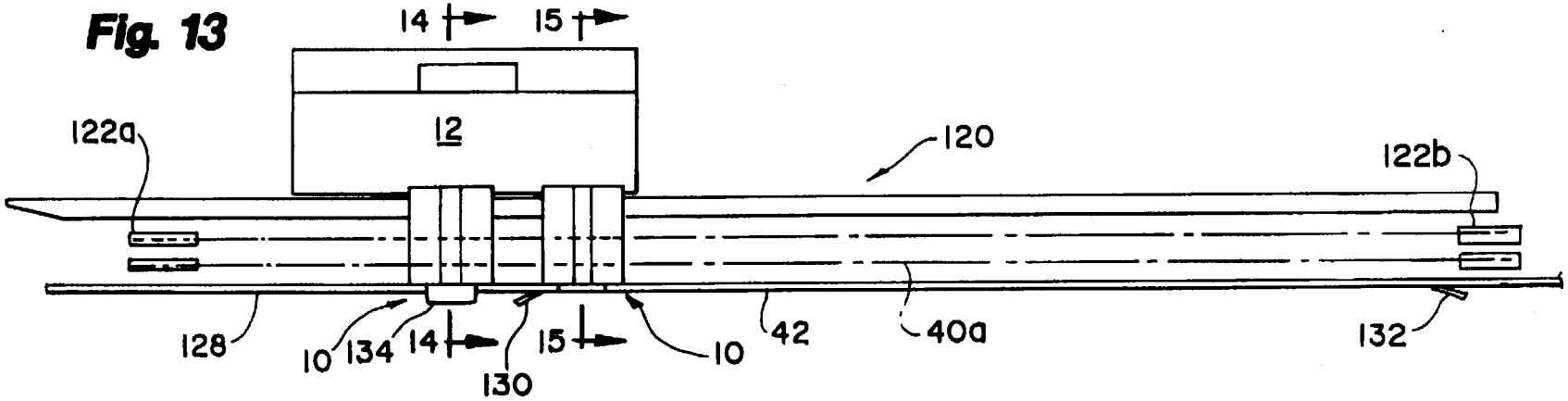
FIG. 13 is a side view of a compression conveyor showing two package squaring devices, the lower plate, and the cam.

FIGS. 12–15 show a plurality of package squaring devices 10 used with a compression conveyor 120. FIG. 12 shows a left and a right flight chain 40*a* and 40*b* used to transport the package squaring devices 10 for folding flaps from two sides of the carton. However, for the cartons 12 shown in FIGS. 16–22, only the right flight chain 40*b* is required to fold the major flap 22 of the carton 12 because the smaller minor flap 24 and tab flaps 26 could be adequately folded using stationary plows (not shown).

Each flight chain 40*a* and 40*b* travels around a pair of sprockets 122*a* and 122*b* and is governed by a forward chain guide 124 and a return chain guide 126. The package squaring devices 10 are supported by a lower plate 128. The cam 42 is integrally constructed with the lower plate 128 and is positioned to contact the bottom 134 of the cam bar 32. The package squaring devices 10 are guided out to contact the cartons 12 by the forward chain guide 124 and stabilize the cartons 12 by inserting finger 74 into carton slot 18. It is anticipated that other methods and devices, such as carton lugs, could be used to stabilize the cartons 12 while the major flap is folded. The cam bar 32 and the flap tucker 34 are raised when the package squaring device 10 travels over the up ramp 130 of the cam 42 and the cam bar 32 and the flap tucker 34 are lowered when the package squaring device 10 travels over the down ramp 132 of the cam 42. Thus, the flap tucker 34 folds the major flap 22 when the cam bar 32 contacts the up ramp 130, maintains this folded position for the glue to set the flap 22 in position while the cam bar 32 rides on the cam 42, and lowers the flap tucker34 away from the flap 22 when the cam bar contacts the down ramp 132.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed is:

1. A package squaring device comprising:

(a) a lug, said lug having a forwardly extending shelf, said shelf having a bias pin aperture;

(b) a flap tucker for folding a flap; and (c) a cam bar linked with said flap tucker, said cam bar being operably positioned proximate to said lug, said cam bar having a top surface, said top surface having a bias pin cavity, a bias pin fitting within said bias pin aperture and said bias pin cavity.

2. The package squaring device of claim 1, wherein said cam bar includes a body portion, a first shoulder, and a second shoulder positioned opposite said first shoulder across said body portion, said first shoulder and said second shoulder being slidably linked to said flap tucker.

3. The package squaring device of claim 1, wherein a bias spring is positioned around said bias pin within said bias pin cavity and below said shelf, and wherein said bias spring provides a downward bias to said cam bar.

4. The package squaring device of claim 1, wherein said lug has an engagement member constructed and arranged to engage and stabilize a carton traveling on a carton conveyance mechanism.

5. The package squaring device of claim 4, wherein said member is a finger constructed and arranged to extend into a slot of said carton.

6. The package squaring device of claim 5, wherein said finger has an arcuate bottom surface, and wherein said surface provides a stabilizing downward force on the carton when said finger is fully inserted within the slot of the carton.

7. A package squaring device comprising:

(a) a lug;

(b) a flap tucker for folding a flap, said flap tucker including;

(i) a first arm having a first load end and a first pivot end, said first pivot end being pivotally connected to said lug;

(ii) a second arm substantially parallel to said first arm, said second arm having a second load end and a second pivot end, said second pivot end being pivotally connected to said lug; and (iii) a cross member attached to said first load end and said second load end, and (c) a cam bar linked with said flap tucker, said cam bar being operably positioned proximate to said lug.

8. The package squaring device of claim 7, wherein said flap tucker is a unitary structure.

9. The package squaring device of claim 7, wherein said first pivot end has a first pivot pin aperture and said second pivot end has a second pivot pin aperture, wherein said lug has a first pivot pin cavity adjacent to said first pivot pin aperture and has a second pivot pin cavity adjacent to said second pivot pin aperture, and wherein a first pivot pin fits within said first pivot pin aperture and said first pivot pin cavity and a second pivot pin fits within said second pivot pin aperture and said second pivot pin cavity.

10. A package squaring device comprising:

(a) a lug;

(b) a flap tucker for folding a flap said, flap tucker having a first cam pin slot and a second cam pin slot;

(c) a cam bar linked with said flap tucker, said cam bar being operably positioned proximate to said lug, said cam bar having a first cam pin cavity and a second cam pin cavity, said first cam pin slot being disposed adjacent to said first cam pin cavity and said second cam pin slot being disposed adjacent to said second cam pin cavity, a first cam pin fitting within said first cam pin cavity and being slidably linked to said flap tucker within said first cam pin slot, a second cam pin fitting within said second cam pin cavity and being slidably linked to said flap tucker within said second cam pin slot.

11. A package squaring device comprising:

(a) a lug, said lug having a front face and both a first leg and a second leg extending forward from said front face, said first leg, said second leg and said front wall forming a cam bar cavity within said lug;

(b) a flap tucker for folding a flap; and (c) a cam bar linked with said flap tucker, said cam bar being operably positioned proximate to said lug, said cam bar being operably positioned within said cam bar cavity.

12. A package squaring device comprising:

(a) a lug, said lug including a main body and a shelf extending forward from said body, said shelf having a first cam bar aperture and a second cam bar aperture;

(b) a flap tucker for folding a flap; and (c) a cam bar linked with said flap tucker, said cam bar being operably positioned proximate to said lug, said cam bar including a body portion, a first shoulder, and a second shoulder positioned opposite said first shoulder across said body portion, said first cam bar aperture and said second cam bar aperture being configured and arranged to slidably receive said first shoulder and said second shoulder of said cam bar.

13. A package squaring device comprising:

(a) a lug;

(b) a flap tucker for folding a flap;

(c) a cam bar linked with said flap tucker, said cam bar being operably positioned proximate to said lug; and (d) a tab plate attached to said lug, said lug and said tab plate forming a cam bar cavity, said cam bar being operably positioned within said cam bar cavity.

14. A package squaring device, comprising:

(a) a lug attached to an endless conveyance apparatus for contacting and stabilizing a carton, said lug including:
(1) a main body;
(2) a shelf extending forward from said body, said shelf having a bias pin aperture;
(3) a front face below said shelf; and
(4) a first pivot pin cavity and a second pivot pin cavity opposite said first pivot pin cavity across said main body;

(b) a flap tucker pivotally connected to said lug for folding a flap on the carton, including:
(1) a first arm having a first load end, a first pivot end, a first pivot pin aperture positioned at said first pivot end, and a first cam pin slot, wherein a first pivot pin fits within said first pivot pin aperture and said first pivot pin cavity;
(2) a second arm having a second load end, a second pivot end, a second pivot pin aperture positioned at said second pivot end, and a second cam pin slot, said first arm and said second arm being substantially parallel, wherein a second pivot pin fits within said second pivot pin aperture and said second pivot pin cavity; and
(3) a cross member attached to said first load end and said second load end; and (c) a cam bar slidably linked to said flap tucker for raising and lowering said flap tucker, including:
(1) a body portion having a top surface, said top surface having a bias pin cavity, wherein a bias pin fits within said bias pin aperture of said shelf and within said bias pin cavity; and
(2) a first shoulder and a second shoulder integrally formed with said body portion, said first shoulder having a first cam pin aperture positioned adjacent to said first cam pin slot of said flap tucker, said second shoulder having a second cam aperture positioned adjacent to said second cam pin slot of said flap tucker, wherein a first cam pin fits within said first pin cavity and is slidably linked with said flap tucker within said first cam pin slot, and said second cam pin fits within said second pin cavity and is slidably linked with said flap tucker within said second cam slot.

15. A package squaring device for folding flaps on cartons traveling on an endless carton conveyance mechanism, said package squaring device comprising:

(a) a lug attached to an endless conveyance apparatus, said lug including:
(1) a main body;
(2) a shelf extending forward from said main body, said shelf having a bias pin aperture, said shelf further having a finger for contacting and stabilizing a carton;
(3) a front face below said shelf;
(4) a first leg and a second leg extending forward from said front face, said first leg having a first tab cavity and said second leg having a second tab cavity; and
(5) a first pivot pin cavity and a second pivot pin cavity opposite said first pin cavity across said main body;

(b) a flap tucker pivotally connected to said lug, including:
(1) a first arm having a first load end, a first pivot end, a first pivot aperture positioned at said first pivot end, and a first cam pin slot, wherein a first pivot pin fits within said first pivot aperture and said first pivot cavity;
(2) a second arm having a second load end, a second pivot end, a second pivot aperture positioned at said second pivot end, and a second cam pin slot, said first arm and said second arm being substantially parallel, wherein a second pivot pin fits within said second pivot aperture and said second pivot cavity; and
(3) a cross member attached to said first load end and said second load end;

(c) a tab having a first tab aperture positioned adjacent to said first tab cavity and further having a second tab aperture positioned adjacent to said second tab cavity, wherein a first tab pin extends through said first tab aperture into said first tab cavity and a second tab pin extends through said second tab aperture into said second tab cavity, and wherein said tab, said first leg, and said second leg form a cam bar cavity; and (d) a cam bar operably positioned within said cam bar cavity, said cam bar including:
(1) a body portion having a top surface, said top surface having a bias pin cavity, wherein a bias pin fits within said bias pin aperture of said shelf and within said bias pin cavity, and wherein a bias spring fits around said bias pin within said bias pin cavity and below said shelf; and
(2) a first shoulder and a second shoulder integrally formed with said body portion, said first shoulder having a first cam pin aperture positioned adjacent to said first cam pin slot of said flap tucker, said second shoulder having a second cam aperture positioned adjacent to said second cam pin slot of said flap tucker, wherein a first cam pin fits within said first pin cavity and is slidably linked with said flap tucker within said first cam pin slot, and a second cam pin fits within said second pin cavity and is slidably linked with said flap tucker within said second cam slot.

16. A continuous compression conveyance apparatus for folding flaps on cartons, comprising:

(a) an endless carton conveyance mechanism for transporting a stream of cartons;

(b) an endless flight of package squaring devices synchronized with the stream of cartons so that at least one of said package squaring devices is operationally adjacent to each carton traveling in the stream of cartons on said endless carton conveyance mechanism, each of said package squaring devices including:
(1) a lug;
(2) a flap tucker for folding flaps on cartons; and
(3) a cam bar linked with said flap tucker, said cam bar being operably positioned proximate to said lug;

(c) a flight guide for positioning said endless flight of said package squaring devices operationally adjacent to said endless carton conveyance mechanism; and (d) a lower plate for supporting each of said package squaring devices, said lower plate having a cam portion extending from a first predetermined position to a second predetermined position, said cam portion being positioned to contact said cam bar of each of said package squaring devices traveling between said first position and said second position, wherein said cam bar is forced upward at said first position and lifts said flap tucker to fold flaps on cartons, and wherein said cam bar is forced down at said second position and lowers said flap tucker.

* * * * *